United States Patent [19]

Kasahima

[11] 3,939,451

[45] Feb. 17, 1976

[54] BALANCE CONTROL FOR USE IN 4-CHANNEL STEREOPHONIC SYSTEM

[75] Inventor: Masao Kasahima, Miyagi, Japan

[73] Assignee: Alps Electric Co., Ltd., Tokyo, Japan

[22] Filed: Mar. 16, 1973

[21] Appl. No.: 341,918

[30] Foreign Application Priority Data

Sept. 6, 1972 Japan ..... 47-89316

[52] U.S. Cl. ..... 338/128; 179/1 VL

[51] Int. Cl.[2] ..... H01C 9/00

[58] Field of Search ..... 338/128, 130, 132, 133; 179/1 VL, 1 D, 1 GQ, 1 G; 403/136, 132, 144, 138

[56] References Cited

UNITED STATES PATENTS

| | | | |
|---|---|---|---|
| 2,507,087 | 5/1950 | Booth | 403/132 |
| 2,866,124 | 12/1958 | Giuffrida | 338/130 |
| 3,027,801 | 4/1962 | Simmon | 338/130 |
| 3,066,963 | 12/1962 | Vogt | 403/138 |
| 3,208,299 | 9/1965 | Leonard | 338/130 |
| 3,629,775 | 12/1971 | Kindred | 179/1 VL |
| 3,711,811 | 1/1973 | Oka | 338/128 |
| 3,745,966 | 7/1973 | Seager | 338/128 |
| 3,746,788 | 7/1973 | Penne | 179/1 GQ |
| 3,760,320 | 9/1973 | Oka et al. | 338/128 |
| 3,813,178 | 5/1974 | Herbenar et al. | 403/138 |

*Primary Examiner*—Kathleen H. Claffy
*Assistant Examiner*—Thomas D'Amico
*Attorney, Agent, or Firm*—Eliot S. Gerber

[57] ABSTRACT

A balance control comprises a box-type frame, a plurality of variable resistors individually mounted on each side wall of the frame, the upper plate of the frame having a large hole, a pair of auxiliary plates attached to the surface opposite the upper plate, each auxiliary plates having a receiving hole, the large hole and the two receiving holes forming a space receiving a ball provided with an operating rod. Either of the auxiliary plates is biased by a resilient member to exert a frictional resistance on the ball. Each pair of shafts of the resistors is ganged by a strip having a slot and the end portion of the operating rod is inserted into a hole defined by the slots of the overlapped strips.

4 Claims, 8 Drawing Figures

FIG. 5A
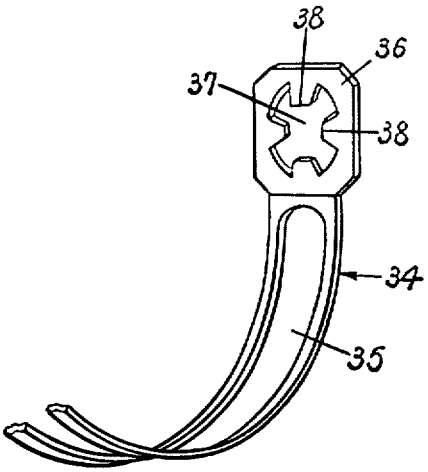
FIG. 5D
FIG. 5B
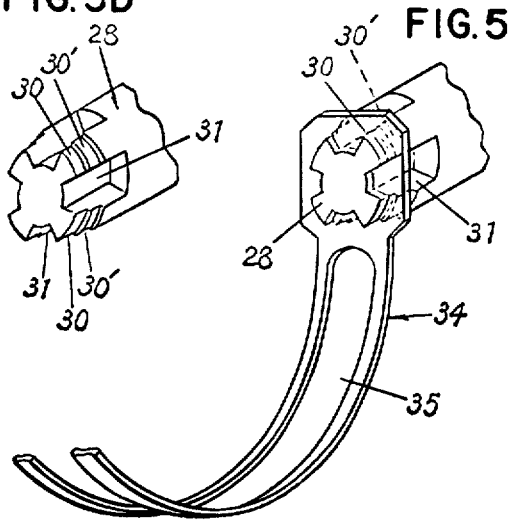
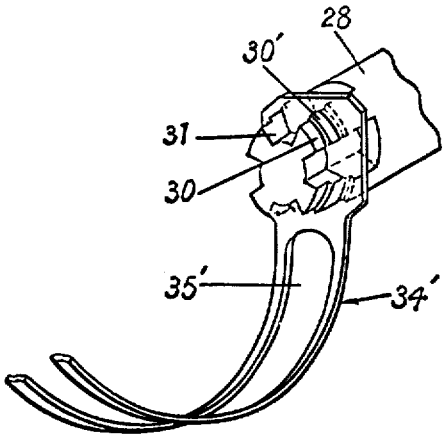
FIG. 5C

BALANCE CONTROL FOR USE IN 4-CHANNEL STEREOPHONIC SYSTEM

BACKGROUND OF THE INVENTION

The present invention relates to a balance control for use in four-channel stereophonic systems or the like. The primary objective of the present invention is to provide a balance control which is quite in its movements and which operates smoothly. It is a further objective that the operating rod of the balance control is reliable. It is a further objective of the present invention to provide a control which is readily and accurately assembled.

SUMMARY OF THE INVENTION

In accordance with the present invention, a balance control is provided which comprises a frame having a large hole on the upper surface thereof, a first auxiliary plate having a receiving hole and a second auxiliary plate having a receiving hole. The auxiliary plates are attached to the respective surfaces opposite the upper portion of said frame. An operation rod is provided attached to a ball, with the rod protruding from opposite ends of the ball. The ball is situated in a space defined by said large hole and the receiving holes of the auxiliary plates. A fixed plate is fitted with a resilient member, either of said auxiliary plates being biased by said resilient member to said ball.

In accordance with another aspect of the present invention, a balance control is provided which comprises a box-type frame and a plurality of variable resistors having rotary shafts of insulating synthetic resin. The resistors are mounted on the side walls of said box-type frame. The resistor shafts are interconnected by ganging strips, each having a slot and each strip ganging two of the shafts. An operation rod has one end coated with a synthetic resin such as nylon etc., that end being inserted into a hole defined by the slots of said overlapped strips.

According to another aspect of the present invention, a balance control is provided which comprises a box-type frame, a plurality of variable resistors having rotary shafts mounted on the side walls of said frame, and ganging strips which have suitable holes in their end portions, each of said shafts having stepped end portions, said stepped end portions being fitted to corresponding ones of said holes.

DESCRIPTION OF THE DRAWINGS

The foregoing and other objects, features and advantages of the present invention will be better understood from the following detailed description with reference to the attached drawings in which;

FIGS. 5A, 5B, 5C and 5D are perspective views showing the coupling of the ganging strips to the rotary shafts, in which FIGS. 5A and 5D are exploded views, FIG. 5B shows the mounting of the ganging strips having small holes at their end portions and FIG. 5C shows the mounting of the ganging strip having large holes at their end portions.

DESCRIPTION OF ONE EMBODIMENT OF THE INVENTION

Figure 1:
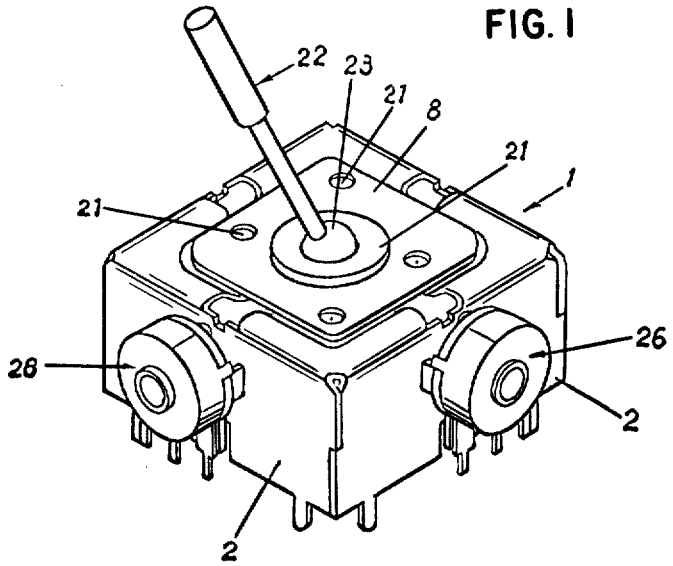
FIG. 1 is a perspective view of a balance control of the present invention.

In the embodiment of the present invention shown in FIGS. 1 through 5, reference number 1 is the box-type frame i.e., in the form of box which is constructed of sheet metal which is pressed into a substantially cubic shape having side walls 2 and an upper portion. A substantial portion of the upper portion is recessed as shown by reference number 3. The side walls have circular holes 4 and rectangular slots 5 are provided on each side of each hole 4. The recessed portion 3 of the upper portion has a large hole 6 in the center thereof and small holes 7 surrounding the center hole.

A first auxiliary plate 8, which is of synthetic plastic resin such as nylon, Delrin (T.M. of DuPont), etc., has a concave receiving hole 9 in the center thereof. The contour of the first auxiliary plate 8 is shaped in such a manner that it can be fitted in the recessed portion 3 of the frame 1 and secured thereto by pins 21 or rivets passing through holes 10 provided in positions corresponding to those of holes 7 of the recessed portion 3. The outer surface of the first auxiliary plate 8 has an annular protrusions 11 at the center portion thereof and the center of the protrusion 11 is a hole 9, the size of the protrusions being sufficient to form a receiving hole. Reference number 12 shows a second auxiliary plate which is attached to the frame 1 in a fashion similar to the first auxiliary plate 8, i.e., holes 14 are provided in positions corresponding to those of holes 10 of the first auxiliary plate 8. The second auxiliary plate 12 is of the same material as that of the first auxiliary plate 8 and a protrusion 15 (see FIG. 2) to form a central receiving hole 13, as in the case of the first auxiliary plate 8.

Reference number 16 is a fixed plate of synthetic resin such as nylon; Derlin (T.M of DuPont), etc., which is provided at substantially its center with a square hole 17 and near the circumference of the hole 17, has an annular groove 18. The area and depth of the portion surrounded by the annular groove 18 are selected to be large enough to receive the protrusion 15 of the second auxiliary plate 12. The fixed plate 16 is further provided with holes 12 in positions corresponding to these holes 19 of the second auxiliary plate 12.

Reference number 20 shows a resilient element such as a wavy metal spring having a suitable resiliency; the resilient element 20 is fitted within the annular groove 18 of the fixed plate 16 to bias the second auxiliary plate 12 upwardly. The first and second auxiliary plates 8 and 12 and the fixed plate 16 are stacked and fastened in line with the recessed portion 3 of the frame 1 as shown in FIG. 2 by inserting the pins 21 through the holes 10 of the first auxiliary plate 8, the holes 7 of the recessed portion 3, the holes 14 of the second auxiliary plate 12 and the holes 19 of the fixed plate 16.

Figure 2:
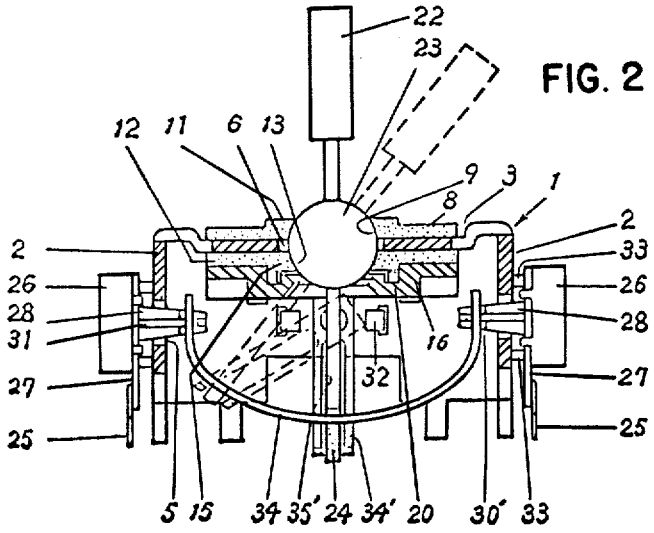
FIG. 2 is a cross sectional side view of the balance control shown in FIG. 1.
Figure 3:
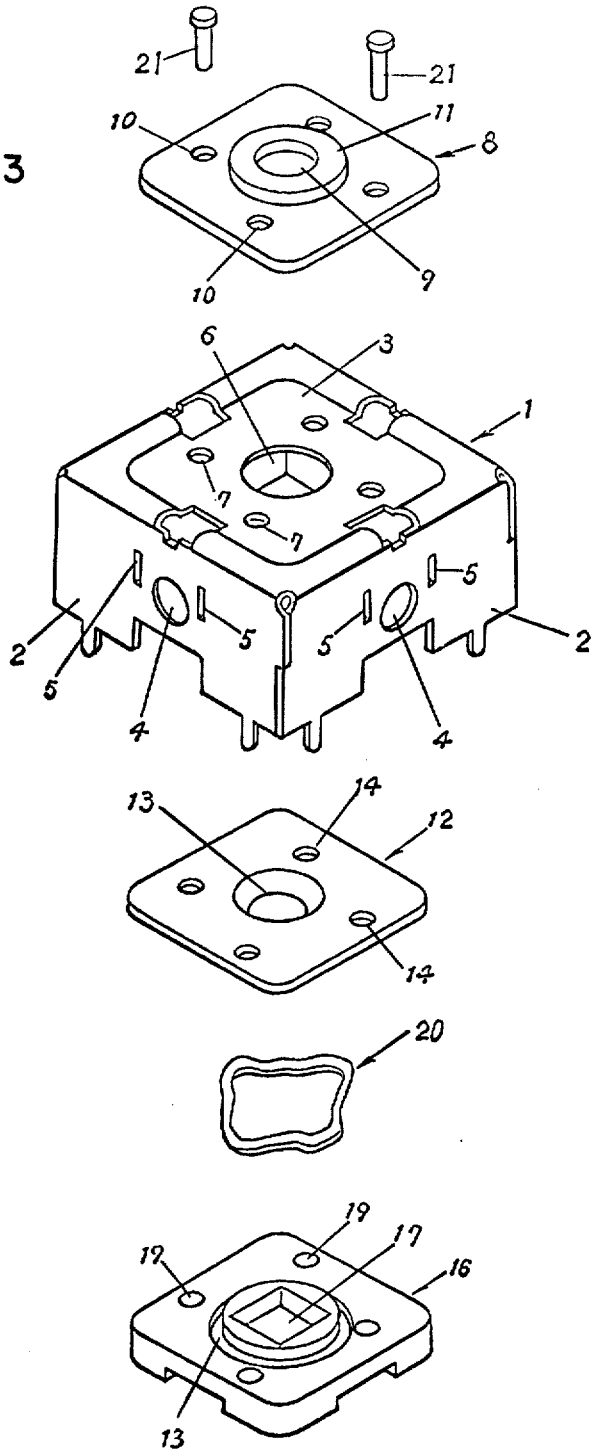
FIG. 3 is an exploded perspective view of the balance control shown in FIG. 1.

In the embodiment of the present invention at FIGS. 1 and 2, reference number 22 shows a metal operation rod. A ball 23 which acts as the fulcrum of the rod 22, is fixed to rod 22 at approximately the mid point of the rod 22, for example by an adhesive. One end portion 24 of the rod 22 is insulated by an electrically insulating synthetic resin tube (sleeve) of nylon, etc.. The pivotal ball 23 is received and slidably held within a spherical space formed by the concave receiving holes 9 and 13 of respectively the first and second auxiliary plates 8 and 12 and the hole 6 of the recessed portion 3 of the frame 1. As the second auxiliary plate 12 is biased upwardly by the resilient element 20, a suitable friction is provided between the ball 23 and the receiving holes 9 and 13 of the first and second auxiliary 8 and 12 to thereby permit the operation rod 22 to be held at any desirable position to which it is moved.

Figure 4:
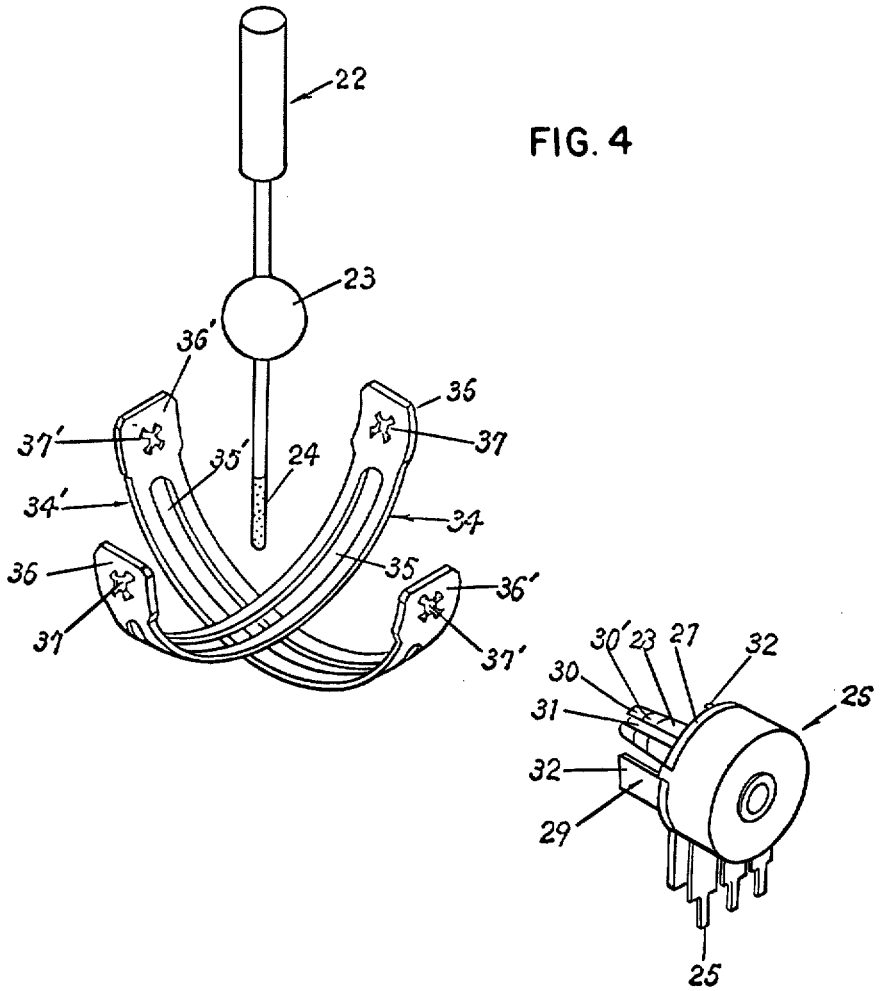
FIG. 4 is an exploded perspective view of the balance control showing the relationship between the operation rod and the ganging strips.

In the exploded view in FIG. 4 reference number 26 illustrates a variable resistor. The variable resistor 26 is comprised of an insulating plate 27 on which a resistor element and terminals, etc. are disposed, a rotary shaft 28, a mounting plate 29 and an internal slider (not shown). The rotary shaft 28 is of insulating synthetic resin such as polycarbonate, etc. and in the form of a frustrum cone. Along the surface of the front portion of the frustrum cone a plurality of axially extending grooves 31 are provided. The front portion is cut-away to form stepped stages 30 and 30'. The mounting plate 29 of the variable resistor 26 is provided with a pair of nails 32 and a pair of protrusions 33 to position the variable resistor 26 in place with respect to the side wall 2 of the frame 1. In order to mount the variable resistors 26 on the frame 1, the nails 32 of each variable resistor 26 are inserted into the rectangular holes 5 provided in the corresponding side walls 2 of the frame 1 until the protrusions 33 make contact with the side wall surface and then the nails 32 are bent. At this time the rotary shaft 28 passes through the hole 4 provided in the side wall 2 and extends inwardly of the frame 1.

Reference number 34 and 34' illustrate generally U-shaped strips (like ganging plates) which are provided with slots 35 and 35' respectively extending along the strips almost the full lengths thereof. In the opposite ends 36 and 36' of the strips 34 and 34', holes 37 and 37' each in the form of a four cross are provided respectively. This shape is selected to match the cross sectional shape of the front portion of the rotary shaft 28. The size of the hole 37 of the strip 34 is slightly smaller than that of the hole 37' of the strip 34'.

In order to couple the strips 34 and 34' to the oppositely disposed pairs of variable resistors 26, the holes 37 of the strip 34 are fitted to the stages 30' on the front portion of the rotary shafts 28 of one part of resistors and the holes 37' of the strip 34' which are smaller than those of the strip 34 are fitted to the stages 30 on the front portion of the shafts 28 of the other pair of resistors which are correspondingly smaller than the stages 30', as shown in FIGS. 5A, 5B and 5C. The fitting (land) portions 38 of the holes 37 and 37' are fitted to the grooves 31 of the rotary shafts 28. The curvatures of the strips 34 and 34' are different and maintained correspondingly by the stages 30 and 30' respectively so that the said strips are not in contact with each other. The end portion 24 of the operation rod 22 which is coated with an insulating synthetic resin is inserted into an opening defined by portions of the slots 35 and 35' of the strips 34 and 34' which are overlapped with a slight space in between.

In the operation of the present balance control, it is assumed that the operation rod 22 is at the position shown in FIG. 2. When the operation rod 22 is moved to any position, such as shown by the dotted line, it pivots the ball 23, which acts as the fulcrum, and to which a suitable frictional resistance is exerted by the resilient member 20. As a result, the end portion 24 of the operation rod 22 causes the ganging strips 34 and 34' to be pivotted and thereby rotate the shafts 28 of the variable resistors 26 to regulate the balance thereof.

In the balance control of the present invention as described herein above, because the frictional resistance exerted on the ball 23 of the operation rod 22 is suitably maintained by the resilient member 20, which biases the auxiliary plate 12 upwardly, the operation rod 22 can reliably and smoothly be universally pivotted. In addition, the assembly of the device is simply performed by fitting the opposite ends of the strips 34 and 34' to the insulated shafts 28 of the variable resistors 26; the insulation of the shafts results in a substantial reduction of noise.

In addition to this effect, since the insulation of the end portion 24 of the operation rod 22 is a synthetic resin, such as nylon, etc., the noise produced during the pivotal movement of the operation rod 22 is very small. Furthermore, as the strips 34 and 34' are fitted to and supported by the stepped stages 30 and 30' formed on the shafts 28, the curvatures of the strips can be maintained so that the two strips are never in contact with each other ensuring smooth pivotal movement of the operation rod 22.

Various modifications of the invention in addition to those shown and described herein will become apparent to those skilled in the art from the foregoing description and accompanying drawings. Such modifications are intended to fall within the scope of the appended claims.

What is claimed is:

1. In combination with a balance control of the type wherein a substantially cubic frame having an upper wall and side walls extending downwardly from the upper wall is provided with a plurality of variable resistors provided with rotary shafts fixed to the side walls, the rotary shafts extending inwardly into the frame, ganging strips secured to the rotary shafts, each of the ganging strips in the shape of an arc and having a longitudinal slot, an operation rod provided with a ball, the ball mounted on the upper wall, the operating rod being inserted through the slots of the ganging strips to move the strips and thereby rotate one or more of the rotary shafts of the variable resistors, the improvement which comprises:

a. the opposite ends of each of the ganging strips provided with holes, the holes of each ganging strip being of a size different from the holes of the other remaining ganging strips;

b. the end portion of each of the rotary shafts being inclined so as to be smaller toward its outer end;

c. the ganging strips being secured to the rotary shafts by inserting the end portion of the rotary shafts into the holes of the ganging strips to the extent allowed by the size of the hole, whereby the radius of the arc of each ganging strip will be determined by the size of the hole of the ganging strip thereby permitting each ganging strip to have an arc of a different radius so that the ganging strips do not come into physical contact with each other although the end portions are the same.

2. The balancing control of claim 1 and further provided with first and second auxiliary plates formed of synthetic plastic resin attached to opposite surfaces of the upper wall of the frame, the upper wall of the frame having a hole, the first and second auxiliary plates each having an opening for receiving the ball of the operation rod, the ball being received in a space defined by the upper wall hole and the openings in the auxiliary plates, a fixed plate, and a resilient member fitted between the fixed plate and one of the auxiliary plates, such that one of the resilient plates is biased by the resilient member toward the ball.

3. The balancing control of claim 1 wherein the holes at the end of each ganging strip are cross-shaped and the end portion of each rotary shaft is a core provided with radially extending flanges.

4. The balancing control of claim 1 wherein the inclined end portion of each rotary shaft has a plurality of steps.

* * * * *